United States Patent [19]

Roy et al.

[11] Patent Number: 4,807,771

[45] Date of Patent: Feb. 28, 1989

[54] TAMPER-EVIDENT CLOSURE

[75] Inventors: Gerald L. Roy, Lancaster; James E. Herr, East Petersburg, both of Pa.

[73] Assignee: Kerr Glass Manufacturing Corporation, Lancaster, Pa.

[21] Appl. No.: 95,547

[22] Filed: Sep. 11, 1987

[51] Int. Cl.[4] ..... B65D 41/34

[52] U.S. Cl. ..... 215/252

[58] Field of Search ..... 215/252

[56] References Cited

U.S. PATENT DOCUMENTS 4,478,343 10/1984 Ostrowsky ..... 215/252

4,572,388 2/1986 Luker et al. ..... 215/252

*Primary Examiner*—Donald F. Norton

*Attorney, Agent, or Firm*—Fitch, Even, Tabin & Flannery

[57] ABSTRACT

A tamper-evident closure for sealing an open-topped container. The closure is of one-piece molded construction and includes a cap having an annular top wall and an annular skirt dependent therefrom and joined thereto about the periphery of the top wall. The skirt has an internal thread for cooperation with the thread on the finish of the container. The closure further includes a tamper-indicating assembly including a band spaced from the skirt by a number of frangible bridges. The assembly also includes a segmented ring connected to the bottom of the band and extending upwardly and inwardly therefrom with the ring including a number of segments with adjacent segments being separated by a slot. The assembly also includes a number of resilient tabs connected to the upper end of each segment and extending upwardly and inwardly therefrom for engaging the breaker ledge of the container finish upon attempted removal of the closure from the container.

11 Claims, 2 Drawing Sheets

TAMPER-EVIDENT CLOSURE

This invention relates to closures for containers and, more specifically, to a closure having a tamper-evident assembly including abutment tabs on a band connected to the cap by breakable bridges.

BACKGROUND OF THE INVENTION

Various designs of tamper-evident closures are known which provide an indication that a container has been opened. Such closures typically have a frangible band assembly which breaks away from the cap (to which it is connected by a number of thin frangible bridges) and remains on the container finish upon the first opening of the container. Certain closures include a large number of tabs extending upwardly and inwardly from the base of the band and abut a large annular shoulder projection or breaker ledge on the container finish beneath the screw thread to cause separation of the tamper-evident band assembly upon the first opening of the container. Such closures work satisfactory with relatively narrow-mouth closures. However, with closures of greater diameter, it is easier for tabs to invert if the tabs are substantially longer and more flexible. This results i the possibility that tabs on adjacent closures might interlock in a hopper or shipping carton and invert with the tabs projecting outwardly and downwardly rather than upwardly and inwardly. While this inversion possibility is small, complete user satisfaction is always desired. For further information concerning the structure and operation of such closures, reference may be made to commonly-assigned U.S. Pat. Nos. 4,511,054 and 4,598,833.

Closures have been proposed which include annular inwardly folded ring which extends upwardly and inwardly from the tamper-evident band for abutting the finish breaker ledge. However, when compared with the easily deflectable tabs, the requirement to stretch a full ring results in the need to apply excessive force to install the closure. When the annular ring on the cap is at a minimum diameter and the glass breaker ledge is at a maximum tolerance diameter, the caps are often damaged when the full annular ring is forced over the breaker ledge. Another disadvantage of the need for increased installation force is the chance of prematurely damaging the bridges. For further information regarding the structure and operation of such closures, reference may be made to U.S. Pat. Nos. 4,613,052 and 4,653,657.

SUMMARY OF THE INVENTION

Among the several aspects and features of the present invention may be noted the provision of an improved tamper-evident closure. The closure of the present invention has relatively low installation force and reduces the possibility of tab inversion and interlocking even when manufactured in wide diameter sizes. Furthermore, the frangible bridges are protected from premature rupture during installation of the cap. Additionally, the closure of the present invention is reliable in use with glass containers of large sizes having considerable variations in diameter and is easy and economical to manufacture. Other aspects and features of the present invention will be, in part, apparent and, in part, pointed out hereinafter in the following specification and accompanying drawings.

Briefly, a closure embodying various aspects of the present invention is of one-piece molded construction and includes a cap including a top wall extending across the opening of the finish and an annular skirt dependent from the top wall with the top wall and skirt being substantially coaxial and with the skirt having an internal thread. The closure further includes a tamper-indicating assembly made up of a band positioned below and spaced from the skirt with a plurality of spaced frangible bridges detachably connecting the upper end of the band to the lower end of the skirt. A segmented ring is connected to the bottom of the band and extends upwardly and inwardly therefrom with the ring being made up of a number of segments, adjacent ones of which are separated by a slot providing more flexibility than a solid, annular flange in passing over maximum tolerance diameters on containers. The assembly further includes a plurality of resilient tabs connected to each segment and extending upwardly and inwardly therefrom with distal tab ends engaging the breaker ledge abutment surface upon attempted removal of the closure after its installation on the finish. The tabs are sufficiently resiliently outwardly deflectable by the breaker ledge cam surface during installation of the closure on the finish so that upon removal of an installed closure, and, on the other hand, the tabs are sufficiently stiff that the free ends of the tabs bearing on the ledge will cause the bridges to break resulting in an indication of tampering.

BRIEF DESCRIPTION OF THE DRAWINGS

Corresponding reference numbers indicate corresponding components throughout the several views of the drawings.

DESCRIPTION OF THE PREFERRED EMBODIMENT

Figure 1:
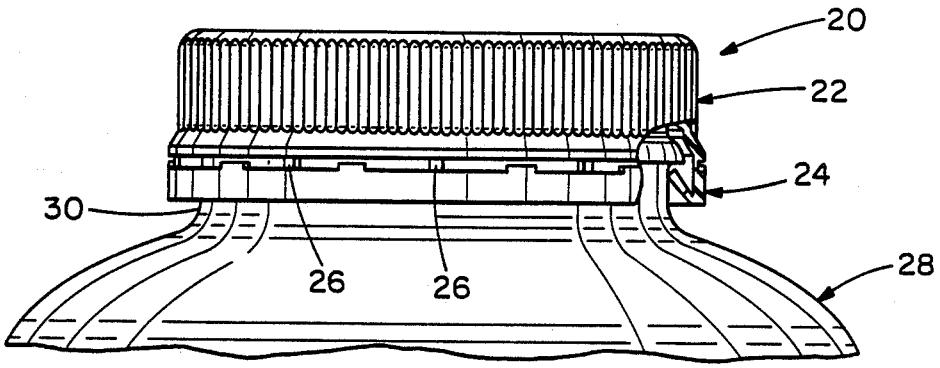
FIG. 1 is a side elevational view of a closure embodying various features of the present invention installed on the finish of a container.
Figure 4:
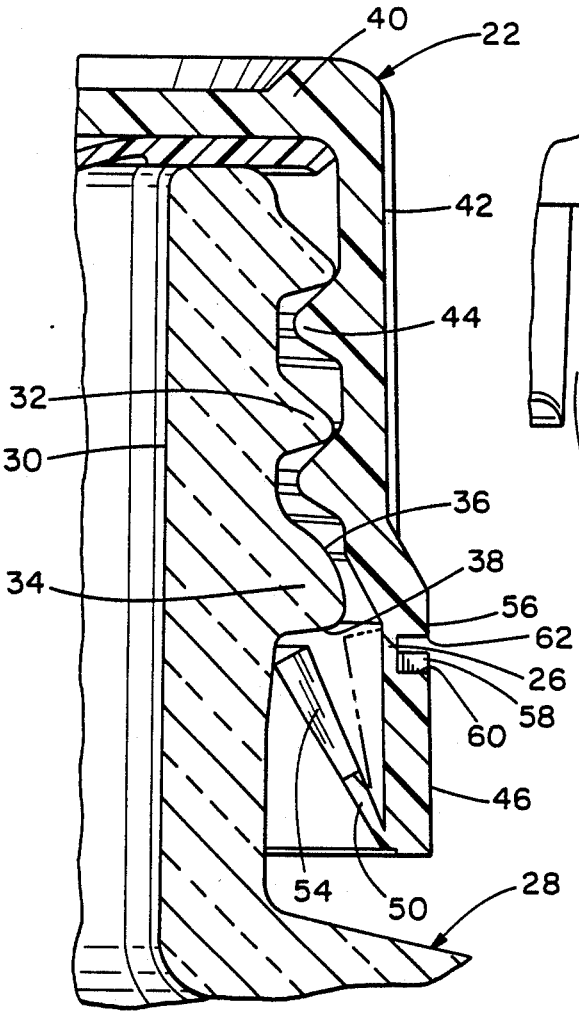
FIG. 4 is a fragmentary, sectional elevational view of the closure of FIG. 1 shown in installed relation upon a container finish, with certain components shown in phantom in a fully deflected position.

Referring to the drawings, a tamper-evident closure embodying various aspects of the present invention is generally indicated by reference numeral 20. The closure 20 is preferably of one-piece molded thermoplastic construction with a preferred material being polypropylene, and includes a cap 22 and a tamper-evident assembly 24 joined to the cap by a number of regularly spaced frangible bridges 26. Closure 20 is useful for sealing an open-topped container 28, portions of which are shown in FIGS. 1 and 4, including a neck or finish 30 having an external screw thread 32 and an annular projecting shoulder or breaker ledge 34 disposed beneath the level of the thread 32. The ledge 34 is provided with an upper cam surface 36 facing the thread and a lower abutment surface 38 remote from the thread. The tamper-evident assembly is, in essence, a one-way device which cooperates with the cam surface to permit relatively low force movement of the assembly beneath the level of the ledge during installation of the closure, but which cooperates with ledge abutment surface to break the bridges when the cap is first removed from the container.

Figure 3:
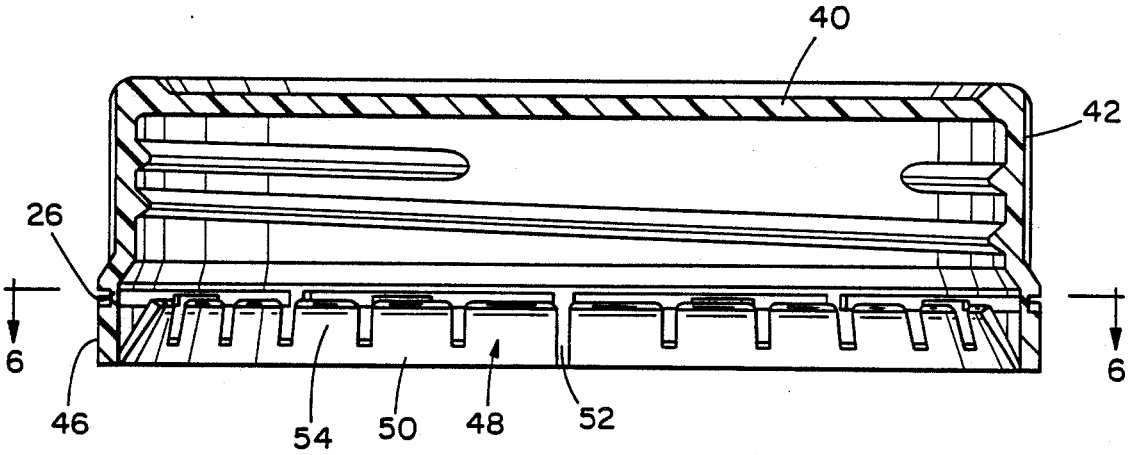
FIG. 3, similar to FIG. 2, illustrates the closure of FIG. 1 in its ready-for-installation condition.

More specifically, the cap 22 includes an annular top wall 40 for extending across the opening of the finish 30. An annular sidewall or skirt 42 is dependent from the top wall 40 and is joined thereto about the periphery of the top wall so that the top wall and the skirt are substantially coaxial. The skirt 42 has an internal screw thread 44 configured to cooperate with the thread of the finish to enable the cap 22 to be installed on and removed from the container 28 by screwing and unscrewing, respectively. The skirt 42 is preferably provided with an internal retention rib adjacent the top of the internal screw thread 44 for retaining a disc of resiliently compressible material which is compressed between the top wall 40 and the open-end of the finish to seal the open end. The exterior surface of the skirt preferably has a large number of regularly spaced axially extending ribs to enhance the user's grip on the cap. The tamper-indicating assembly 24 is best shown in its ready-for-application condition in FIGS. 3 and 6 and comprises a band 46 of relatively thick cross section connected to the outwardly flaring bottom of the skirt by the thin bridges 26.

In accordance with the present invention, the tamper-evident band has increased rigidity over the tabs on the closure of U.S. Pat. No. 4,511,054 because of a segmented ring 48 and has greater flexibility for large diameter tolerances than the full annular ring of U.S. Pat. No. 4,653,657 because of tabs 54 projecting from the ring segments to engage the breaker ledge. The segmented ring 48 is connected to the base of the band and extends upwardly and inwardly therefrom. The ring 48 is made up by three to five segments 50, four being preferable, with adjacent segments separated by a slot 52 extending substantially to the band. A plurality of resilient tabs 54 is connected to the distal end of each segment for engaging the abutment surface 38 of the breaker ledge 34. There are preferably six to ten tabs carried by each segment with eight per segment being most preferable.

Figure 2:
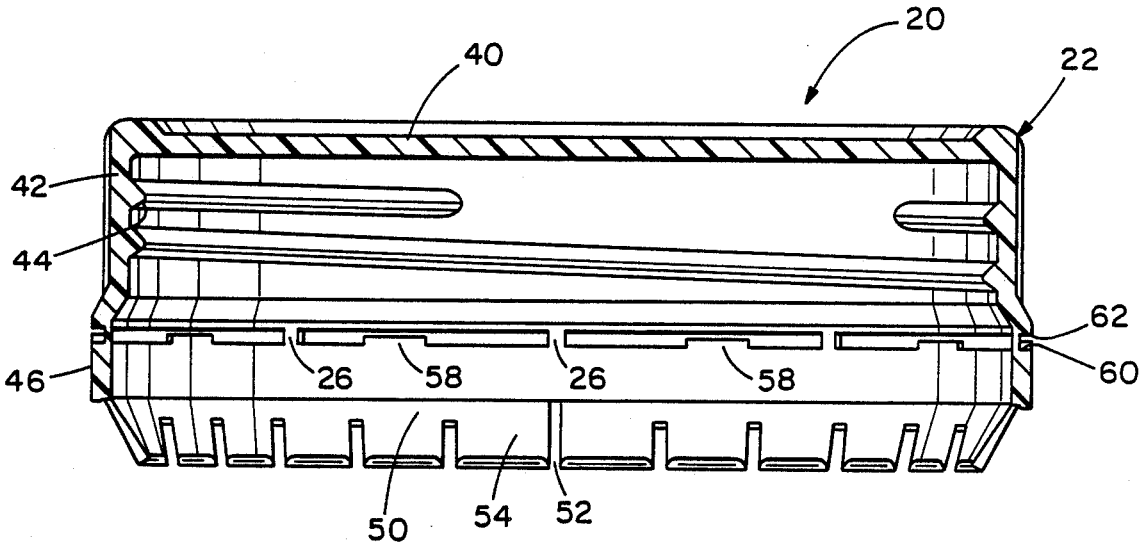
FIG. 2 is a cross-sectional view of the closure of FIG. 1 in its as-molded condition showing a tamper-evident assembly including a band and abutment tabs extending from a segmented ring joined to the band.
Figure 5:
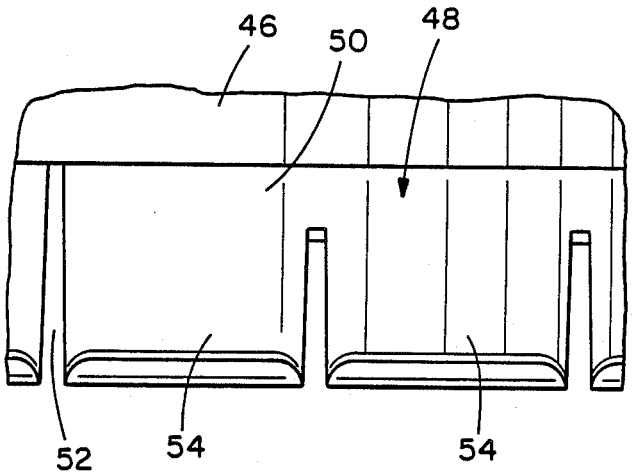
FIG. 5 is a enlarged fragmentary front elevational view of the closure in its as-molded condition depicting tabs extending from a ring segment.

Referring to FIGS. 2 and 5, in the as-molded condition of the closure, the ring and tabs extend downwardly because this configuration permits simplification in the molding process and equipment. Within a short time after molding the segment ring and the tabs are reoriented by rolling or any other suitable means, as well known by those of skill in the art, to extend upwardly. Heat may be applied to destroy the plastic memory at the hinge area, if desired. Thus, the components will remain in ready-for-installation position depicted in FIGS. 3 and 6.

As best shown in FIG. 4, the tabs increase in thickness with distance from their connected ends and, as shown in FIG. 5, have a slight decrease in width from their connected ends. The segments 50 also increase in thickness with distance from the band with the segments and tabs having substantially equal thickness at their juncture. The increase in thickness provides some increase in stiffness but also aids in preventing the tabs from being bent over the breaker ledge without breaking the bridges. This is termed "tiring off" in the manner that a tire is canted and inclined and peeled about the tire rim.

Referring to FIG. 4, the internal diameter at the base of the skirt and the internal diameter of the band 46 are substantially equal. The tabs 54 have their greatest thickness at their free ends to take up tolerances and prevent tiring off of the tamper-evident band with the cap during cap removal. As shown in phantom in FIG. 4, installation of the closure 20 of the finish 30 causes substantially full outward deflection of the tabs 54 but does not result in substantial deformation as would break the bridges 26.

Adjacent bridges 26 are spaced by abutment blocks 58 which function to limit movement of the band 46 toward the bottom 56 of the skirt during installation of the closure to protect against premature breakage of the bridges. More specifically, the blocks 58, which may be of rectangular cross section, extend from the top surface 60 of the band 46 about halfway toward the bottom surface 62 of the skirt. The relatively thin bridges, as shown in FIG. 4, are positioned at the inside of the band whereas the relatively thick blocks 58 have the same thickness as the band and skirt bottom and are aligned therewith. Accordingly, the blocks have much greater column strength than the bridges. During a downward closure application, the thin bridges 26 may buckle and permit the bottom surface of the skirt to abut the top surface of the blocks 58 and prevent further buckling of the bridges to the extent that the bridges are damaged or broken.

Figure 6:
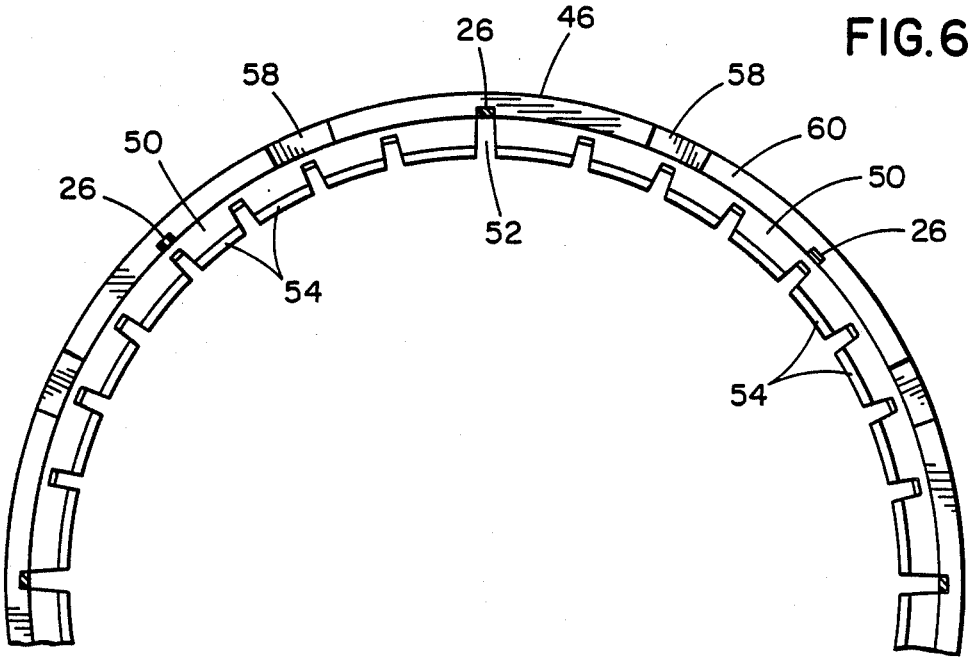
FIG. 6 is a sectional view of the closure taken generally along line 6—6 of FIG. 3.

The combination of the segmented ring 48 and the tabs 54, which preferably have a somewhat greater length than the ring, provides important advantages over conventional closures particularly in sizes having large diameters. Prior art connectors in which the numerous tabs extend to the band can be inadvertently inverted particularly in the wide diameter sizes. This can result in the tabs of adjacent closures in a shipping carton becoming entangled, requiring manual separation of closures intended to be applied by automated equipment. As shown in FIG. 6, each of the segments is folded upwardly and inwardly when put into a feeding hopper for an automatic capping machine. Because the long arcuate ring segment is much stiffer than would be a narrow long tab (if the ring segment were not used in U.S. Pat. No. 4,511,054) the ring segment will not be inadvertently inverted as it would, with its relatively high stiffness, have to be pulled over center and then to a reversely bowed configuration. Even if one of the tabs were acted upon by a force trying to invert it or its attached ring segment, the ring is sufficiently stiff that it should not invert. Still the closure provides acceptably low installation force because the relatively flexible tabs can be easily deflected by the downwardly sloping cam surface 36 of the breaker ledge 34. The segmented ring can also be deflected without excessive force because no full hoop kind of stretching is required (as would be required for installation of a full ring).

Operation of the closure 20 of the subject invention is as follows: Upon placing the closure over the open end of the container finish 30 and engaging the cooperating screw threads 32 and 44, screwing of the closure results in the segmented ring 48 engaging the cam surface 36 of the breaker ledge 34. Continued screwing of the closure onto the container causes the cam surface to deflect the ring segments 50 and then deflect the tabs 54 carried by the segments. As shown in phantom in FIG. 4, when the tabs are fully deflected they are disposed adjacent or against the inside surfaces of the band 46, the bridges 26 and the lower portion of the skirt 42. When the free ends of the tabs 54 pass the greatest diameter portion of the breaker ledge, the tabs, due to their resiliency, will return toward their undeflected position and engage the finish exterior surface beneath the level of the breaker ledge 34.

It will be appreciated that during application of the closure, the bridges may undergo some slight buckling or bowing as the cap 22 moves toward tamper-evident assembly 24 due to the drag of the segments 50 and/or tabs 54 on the breaker ledge. This bowing is limited by the presence of the blocks 58 which engage the bottom surface 62 of the skirt 42 to limit movement of the band toward the skirt thereby protecting the bridges from breakage or other premature damage during closure installation.

Upon attempted unthreading of the cap, the free ends of the tabs are brought into engagement with the abutment surface 38 of the breaker ledge 34. Continued unscrewing causes the tabs to more forcefully bear upon this surface. The resistive strength of the tabs 54 is greater than the rupture strength of the bridges 26 so that upon continued application of unscrewing forces the bridges rupture allowing the cap to be removed, with the tamper-evident assembly 24 remaining captured on the finish beneath the level of the breaker ledge thereby providing positive indication that the container has been opened.

In view of the above, it will be seen that the several objects of the invention are achieved and other advantageous results attained.

As various changes could be made in the above construction without departing from the scope of the invention, it is intended that all matter contained in the above description shall be interpreted as illustrative and not in a limiting sense.

What is claimed is:

1. A tamper-evident closure for sealing an open-topped container having a finish with an external screw thread and an annular breaker ledge disposed beneath the level of said thread, said ledge including an upper cam surface facing said thread and a lower abutment surface remote from said thread, said closure being of one-piece molded construction and comprising:

a cap including an annular top wall for extending across the opening of said finish, and an annular skirt dependent from said top wall and being joined thereto about the periphery of said top wall so that said top wall and said skirt are substantially coaxial, said skirt being provided with an internal thread configured to cooperate with the thread of said finish to enable said cap to be installed on and removed from said container by relative rotation between the cap and the container; and a tamper-indicating assembly comprising a band positioned below and spaced from said skirt, a plurality of spaced frangible bridges, detachably connecting the upper end of said band to the lower end of said skirt, a plurality of spaced-apart ring segments, each including an annular end and a flexible hinge portion opposite the end which connects the ring segment to the bottom of said band so that said ring segment extends upwardly and inwardly therefrom, with adjacent ring segments separated by a slot extending through substantially the entire cross-section of said ring, from the end of the ring to the bottom of said band so as to define independently foldable ring segments between the slots, and a plurality of resilient tabs connected to the end of each ring segment so as to extend upwardly and inwardly therefrom for engaging said ledge abutment surface upon attempted removal of said closure after installation on said finish, said tabs being resiliently outwardly deflected by said ledge cam surface during installation of said closure on said finish whereby upon removal of an installed closure, the free ends of said tabs bear on said ledge causing said bridges to break resulting in an indication of tampering.

2. A closure as set forth in claim 1 in which abutment blocks extend from one of said skirt and said band toward, but short of, the other of said skirt and said band, said abutment blocks having substantially greater column strength than said bridges whereby said blocks limit movement of said band toward said cap during installation to protect said bridges from premature breakage.

3. A closure as set forth in claim 2 wherein there is a said block between each pair of adjacent bridges, said blocks extending from said band.

4. A closure as set forth in claim 1 wherein said tabs have increasing thickness with distance from their connected ends.

5. A closure as set forth in claim 1 wherein said tabs decrease in width with distance from their connected ends.

6. A closure as set forth in claim 1 wherein said segments increase in thickness with distance from said band.

7. A closure as set forth in claim 1 wherein the number of said segments is in the range of three to five and the number of tabs on each segment is in the range of six to ten.

8. A closure as set forth in claim 1 wherein said skirt includes a portion below said internal thread which flares outwardly, the internal diameter at the bottom of said skirt and the internal diameter of said band being substantially equal.

9. A closure as set forth in claim 8 wherein the greatest thickness of said segments and said tabs is at the free ends of said tabs, the spacing between said breaker ledge and said band being substantially equal to the thickness of said tab ends so that installation of said closure causes substantially full outward deflection of said tabs but does not result in substantial deformation of any component of said closure.

10. A closure as set forth in claim 9 wherein the combined length of said segments and tabs is greater than the combined length of said band and said bridges so that when a tab is fully deflected the distal end of the tab engages the bottom of said skirt.

11. A tamper-evident closure for sealing an open-topped container having a finish with an external screw thread and an annular breaker ledge disposed beneath the level of said thread, said ledge including an upper cam surface facing said thread and a lower abutment surface remote from said thread, said closure being of one-piece molded construction and comprising:

a cap including an annular top wall for extending across the opening of said finish, and an annular skirt dependent from said top wall and being joined thereto about the periphery of said top wall so that said top wall and said skirt are substantially coaxial, said skirt being provided with an internal thread configured to cooperate with the thread of said finish to enable said cap to be installed on and removed from said container by relative rotation; and a tamper-indicating assembly comprising a band positioned below and spaced from skirt, a plurality of spaced frangible bridges, detachably connecting the upper end of said band to the lower end of said skirt, a segmented ring including a folded hinge connecting the ring to the bottom of said band so as to extend upwardly and inwardly therefrom, the ring having an end opposite the hinge and having a plurality of spaced-apart slots defined therein of said ring, from the end of the ring to the bottom of said band, so as to define independently foldable ring segments between the slots; and a plurality of substantially identical resilient tabs connected to the ends of said ring segments and not joined to said band and extending upwardly and inwardly therefrom for engaging said ledge abutment surface upon attempted removal of said closure after installation on said finish, said bridges breaking upon unscrewing of said cap with said ring being spaced from said ledge when the first bridge ruptures.

* * * * *

UNITED STATES PATENT AND TRADEMARK OFFICE

CERTIFICATE OF CORRECTION

PATENT NO. : 4,807,771

DATED : February 28, 1989

INVENTOR(S) : Gerald L. Roy, James E. Herr

It is certified that error appears in the above-identified patent and that said Letters Patent is hereby corrected as shown below:

Column 1, Line 22, change "satisfactory" to --satisfactorily--.

Column 1, Line 26, change "i" to --in--.

Column 1, Line 36, after "include" insert --an--.

Column 2, Line 45, change "a" to --an--.

Column 7, Line 14, after "therein" insert --extending through substantially the entire cross-section--.

Signed and Sealed this

Eleventh Day of July, 1989

*Attest:*

DONALD J. QUIGG

*Attesting Officer*

*Commissioner of Patents and Trademarks*